US006241479B1

(12) United States Patent
Döbbeling et al.

(10) Patent No.: US 6,241,479 B1
(45) Date of Patent: Jun. 5, 2001

(54) SUPERSONIC CENTRIFUGAL COMPRESSION AND SEPARATION OF LIQUID AND GAS MIXTURE

(75) Inventors: Klaus Döbbeling, Windisch; Bettina Paikert, Oberrohrdorf, both of (CH)

(73) Assignee: ABB Research Ltd., Zurich (CH)

( * ) Notice: Subject to any disclaimer, the term of this patent is extended or adjusted under 35 U.S.C. 154(b) by 0 days.

(21) Appl. No.: 09/391,400

(22) Filed: Sep. 8, 1999

(30) Foreign Application Priority Data

Sep. 28, 1998 (EP) ..... 98 81 0976

(51) Int. Cl.[7] ..... F04F 11/00; F04B 17/00
(52) U.S. Cl. ..... 417/66; 417/423.1
(58) Field of Search ..... 417/66, 67, 423.1; 415/129.2, 169.4, 181

(56) References Cited

U.S. PATENT DOCUMENTS

| | | | | |
|---|---|---|---|---|
| 3,134,338 | | 5/1964 | Dodge | 417/194 |
| 3,200,764 | * | 8/1965 | Saunders, Jr. | 417/185 |
| 5,083,429 | | 1/1992 | Veres et al. | 60/325 |
| 5,338,113 | * | 8/1994 | Fissenko | 366/177 |
| 5,544,961 | * | 8/1996 | Fuks et al. | 366/163.2 |
| 5,580,214 | * | 12/1996 | Mohn | 415/169.2 |
| 5,813,847 | * | 9/1998 | Eroglu et al. | 431/8 |

FOREIGN PATENT DOCUMENTS

| | | |
|---|---|---|
| 339906 | 8/1921 | (DE) . |
| 870208 | 3/1953 | (DE) . |
| 0155024A1 | 9/1985 | (EP) . |
| 169683 | 1/1922 | (GB) . |
| 327051 | 3/1930 | (GB) . |
| WO90/05583 | 5/1990 | (WO) . |
| WO93/16791 | 9/1993 | (WO) . |

* cited by examiner

*Primary Examiner*—Timothy S. Thorpe
*Assistant Examiner*—Michael K. Gray
(74) *Attorney, Agent, or Firm*—Burns, Doane, Swecker & Mathis, L.L.P.

(57) ABSTRACT

In a method of compressing a gas, a compression which is simple to realize is achieved in that, in a first step, a foam (21) is formed from the gas and a liquid, in which foam (21) the sonic velocity is markedly lower than in the gas and in the liquid taken by themselves, in that, in a second step, the foam is directed at supersonic velocity through a nozzle (19, 20) and the gas located in the foam is thereby compressed, and in that, in a third step, the compressed gas and the liquid are separated from one another behind the nozzle (19, 20).

16 Claims, 2 Drawing Sheets

SUPERSONIC CENTRIFUGAL COMPRESSION AND SEPARATION OF LIQUID AND GAS MIXTURE

BACKGROUND OF THE INVENTION

1. Field of the Invention

The present invention relates to the field of compression technology. It concerns a method of compressing a gas and a compression apparatus for carrying out the method.

2. Discussion of Background

In the prior art (see, for example, the publication U.S. Pat. No. 5,083,429) it has already variously been proposed to compress a flowing gaseous medium by first of all accelerating it to supersonic velocity in a suitable device (compression tube) and then decelerating it again with the generation of shock waves and subsequent increase in pressure. The heat produced during the compression may be dissipated, for example, by spraying water into the corresponding tube section. A disadvantage with this type of compression is that the sonic velocity of the gaseous medium (e.g. air) is generally relatively high and that some outlay is therefore required in order to bring the gas flow to supersonic velocity.

SUMMARY OF THE INVENTION

Accordingly, one object of the invention is to provide a novel method and a novel apparatus for the compression of a gaseous medium, which method and apparatus can work at a markedly reduced sonic velocity and can therefore be realized with reduced outlay.

The object is achieved in a method of the type mentioned at the beginning in that, in a first step, a foam is formed from the gas and a liquid, in which foam the sonic velocity is markedly lower than in the gas and in the liquid taken by themselves, in that, in a second step, the foam is directed at supersonic velocity through a nozzle and the gas located in the foam is thereby compressed, and in that, in a third step, the compressed gas and the liquid are separated from one another behind the nozzle. The essence of the invention consists in using a foam-like gas/liquid system for the compression, this gas/liquid system being distinguished by a sonic velocity which is markedly reduced compared with the individual components. In this way, it is possible with reduced outlay to achieve the supersonic velocity required for the compression operation. At the same time, the heat produced during the compression can be dissipated in a simple manner via the liquid, which is to be separated off again subsequently.

A preferred embodiment of the method according to the invention is distinguished by the fact that an essentially static foam is produced, that the nozzle is moved at supersonic velocity through the foam, and that the movement of the nozzle is executed as a circular movement about an axis of rotation. This way of conducting the method proves to be especially favorable for realizing the method in terms of equipment.

A development of this embodiment which is preferred on account of its simplicity is distinguished by the fact that the foam is collected behind the nozzle in a collecting container moving along with the nozzle, and that the centrifugal force arising in the collecting container during the rotation is used for the separation of gas and liquid.

Another preferred embodiment of the method according to the invention is distinguished by the fact that, to produce the foam, the gas is introduced into a volume of the liquid in a distributed manner, and that the gas is introduced from below through a porous base into a layer of the liquid above the base. In this way, a fine-pored foam, which is especially suitable for the compression according to the invention, can be produced over a large area without moving parts.

The compression apparatus according to the invention for carrying out the method according to the invention comprises a container for the foam produced, which container is connected to first means for producing the foam, as well as at least one nozzle, which can be moved relative to the foam in such a way that the foam passes at supersonic velocity through the nozzle, as well as second means for the separation of the foam into gas and liquid, which second means are arranged behind the nozzle.

A first preferred embodiment of the apparatus according to the invention is distinguished by the fact that the first means comprise a porous base, which closes off the container at the bottom and to which gas can be admitted over the surface area from the underside, that the at least one nozzle is arranged inside the container on an arm so as to be rotatable about a central axis of rotation and essentially tangentially to the circle of rotation, that the arm is driven by a motor, that the second means in each case comprise a collecting container, which is attached behind the nozzle, is connected to the nozzle and is in each case arranged on the end of the arm, and that in each case third means for the separate discharge of the gaseous and liquid components separating during the rotation are provided in the collecting container.

A preferred development of this embodiment is distinguished by the fact that the arm is in each case of tubular design, that the third means comprise a first inner tube running in each case inside the arm, and that the liquid is drawn off through the first inner tube and the gas is drawn off in the intermediate space between the first inner tube and the arm.

Further embodiments follow from the dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
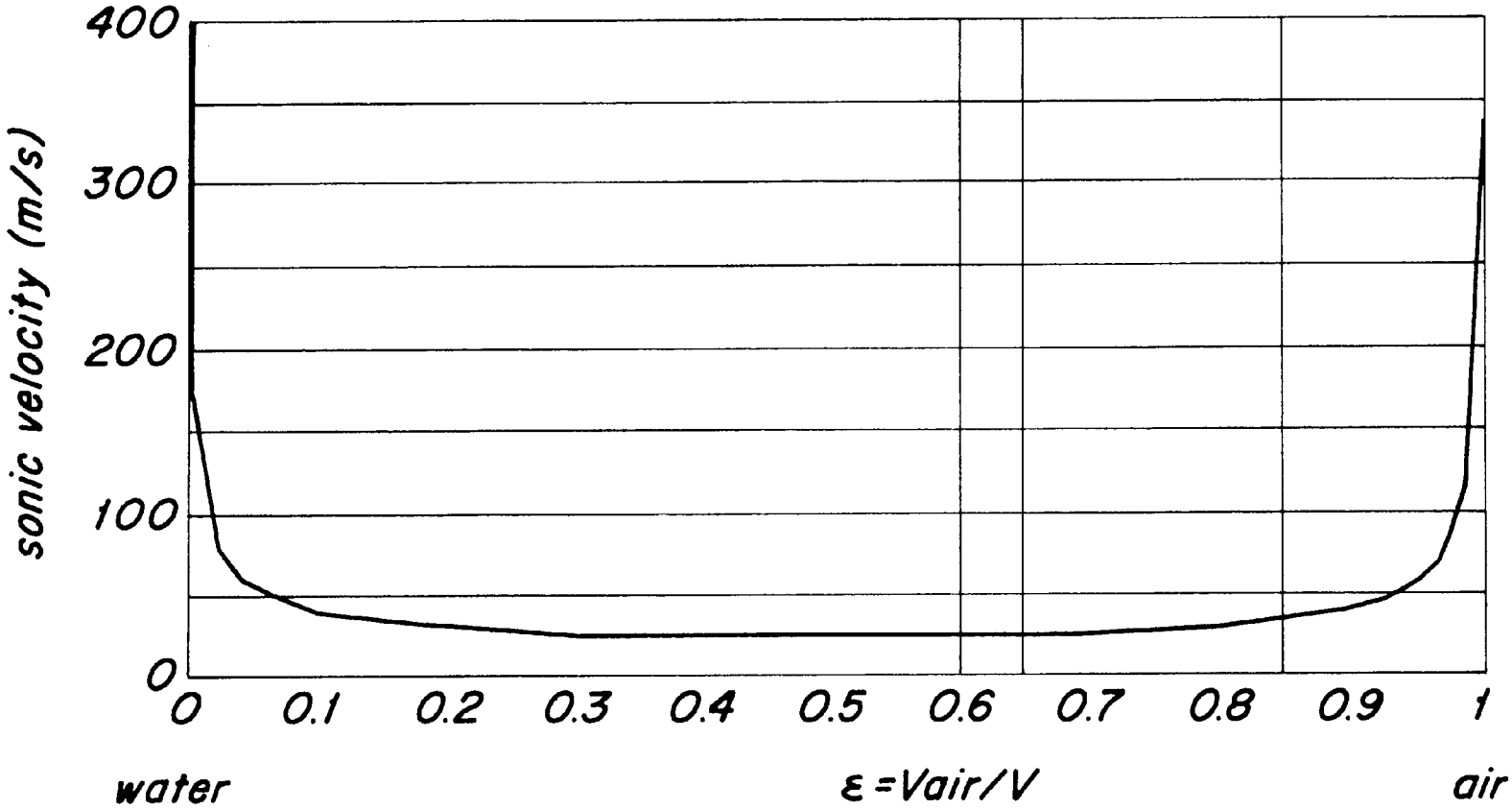
FIG. 1 shows a diagram of the sonic velocity in an air/water system plotted against the ratio $\epsilon$ of the air volume $V_{air}$ to the total volume V of the air/water mixture.

Referring now to the drawings, wherein like reference numerals designate identical or corresponding parts throughout the several views, an essential feature of the present invention is the use of a gas/liquid system for the compression of the gas itself. In two-phase gas/liquid flows, the sonic velocity is often much lower than the sonic velocity of the pure gas or of the pure liquid. Thus, for example, the sonic velocities are less than 40 m/s in an air/water system if the volumetric ratio $\epsilon$ of air to the mixture as a whole is between 0.1 and 0.9 (FIG. 1). This means that supersonic velocity can be produced relatively simply and that such a mixture can be compressed to a high degree by a reduction in the cross section of flow.

A special form of such a gas/liquid or air/water mixture is foam. Foam is distinguished by high volumetric proportions of gas or air ($\epsilon \approx 0.9$). Foam is defined as a dispersion of gas in a liquid which contains one or more surface-active substances. The liquid is mainly present in the form of thin films as an envelope of the bubbles present in the foam. The size (diameter) of the bubbles varies between a few micrometers (fine-pored foam) and several millimeters (coarse-pored foam). The surface-active substances are soluble in the liquid and reduce its surface tension, so that the formation of stable bubbles is made possible. In the exemplary air/water mixture, foam may be formed, for example, by means of a 1.5% butyl/glycol/water solution and air. The mixture may range from a 1 to 5% solution with a 1.5% being preferred.

Figure 2:
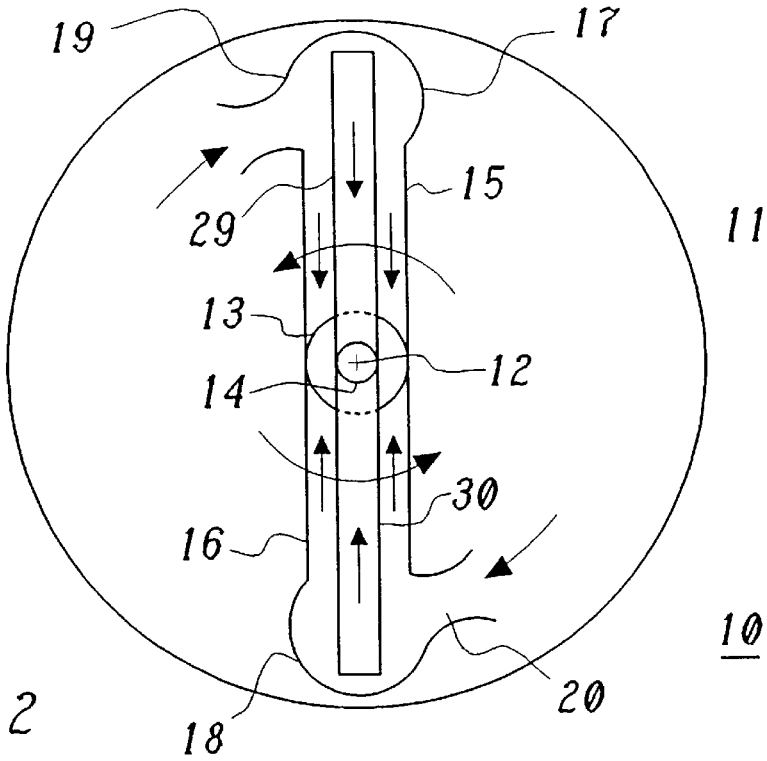
FIG. 2 shows a plan view of a preferred exemplary embodiment of a compression apparatus having two nozzles on two arms.
Figure 3:
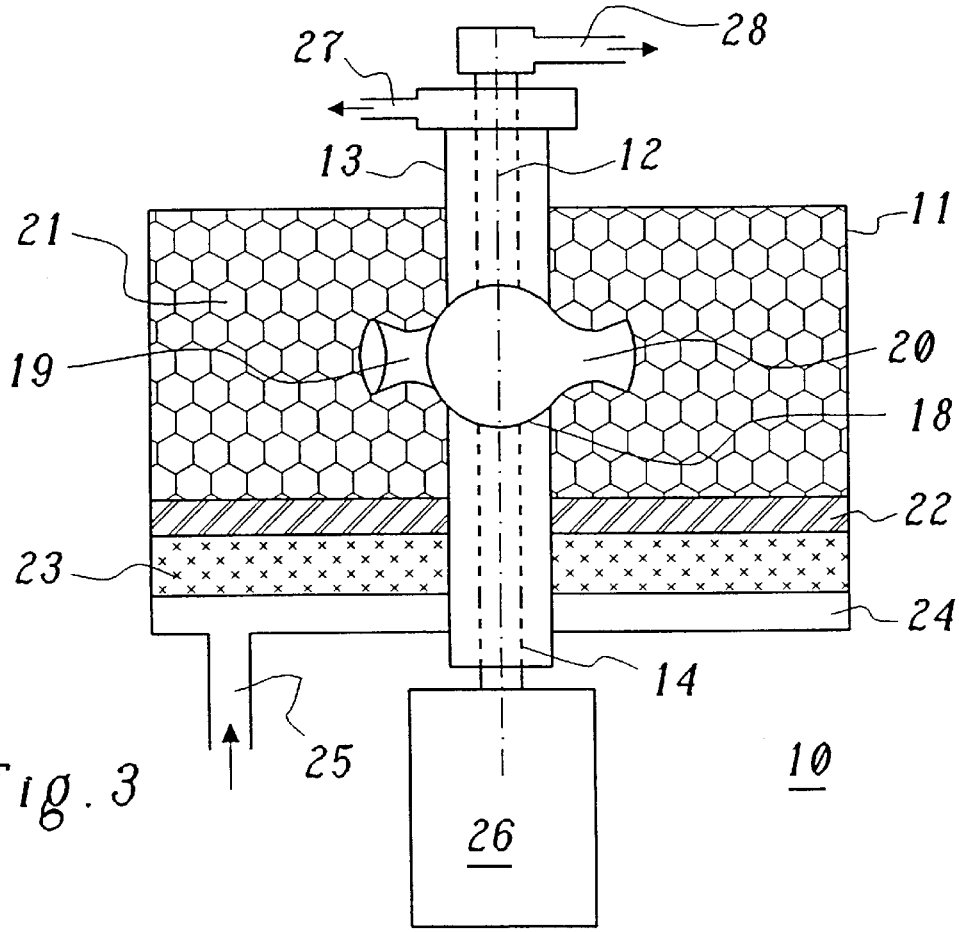
FIG. 3 shows the compression apparatus according to FIG. 2 in partly sectioned side view.

The method according to the invention may now be carried out by means of a compression apparatus, of which a preferred exemplary embodiment is reproduced in FIGS. 2 and 3. The compression apparatus 10 shown comprises a container 11, in which the desired foam 21 is produced. The container 11 is closed off at the bottom by a porous base 23, above which there is always a layer of the liquid 22 used (in particular water plus surface-active substances) during the operation of the compression apparatus 10. Arranged below the porous base 23 is a feed space 24, which can be filled via a feed 25 with the gas used (in particular air), which is to be compressed. The gas passes in the form of small bubbles from the feed space 24 through the porous base 23—which may also be designed as a perforated plate or the like—penetrates into the liquid 22 above it and produces the foam 21 when passing through the liquid 22, the foam 21 filling the container 11 above the liquid 22 to a more or less considerable degree.

In the region of the foam 21, a system is arranged inside the container 11 so as to be rotatable about a central axis of rotation 12, and this system is moved at a circumferential velocity which is higher than the sonic velocity of the foam 21, by means of a motor 26 (or a drive having the same effect), catches the foam 21 at this circumferential velocity and causes it to flow through a reduction in cross section. To this end, two tangentially directed nozzles 19, 20 are provided on two opposite arms 15, 16, through which nozzles 19, 20 the foam 21, which is static relative to the nozzles 19, 20 rotating about the axis of rotation 12, flows and passes into collecting containers 17, 18 at the rear. It goes without saying that, instead of the two nozzles 19, 20 shown in the example, only one nozzle or more than two nozzles may also be used.

In the collecting containers 17, 18, an inner tube 29, 30 running concentrically inside the tubular arm 15, 16 ends in each case in front of the container wall. The radial inner tubes 29, 30 are run to an axial inner tube 14, lying in the axis of rotation 12, and are attached to this inner tube 14. The tubular arms 15, 16 connect the collecting containers 17, 18 to an axial outer tube 13, which concentrically surrounds the axial inner tube 14. The axial tubes 13, 14 serve as a shaft. The axial tubes 13, 14 and the arms 15, 16 fastened to them are rotated by the motor 26 arranged under the container 11. The axial tubes 13, 14 are closed at the bottom. They are accessible from outside at the top through suitable outlets 27, 28.

The compression apparatus 10 shown in FIGS. 2 and 3 now functions as follows: the two nozzles 19, 20—driven by the motor 26—rotate together with the associated collecting container 17, 18 counter-clockwise (rotation arrows in FIG. 2) in the container filled with the foam 21. In the case of the exemplary and preferred air/water mixture, the velocity of rotation is about 100 m/s, i.e. the nozzles 19, 20 move relative to the foam 21 at supersonic velocity. Such a velocity can be achieved, for example, if the rotational frequency of the motor 26 is 50 Hz and the nozzles 19, 20 are at a distance of about 0.3 m from the axis of rotation 12.

Compression of the 2-phase mixture occurs in the nozzles 19, 20. The liquid (the water) is centrifuged radially outward in the collecting contains 17, 18 behind the nozzles 19, 20 on account of the centrifugal force and is transported via the radial inner tubes 29, 30 and the axial inner tube 14 to the outlet 28. The liquid discharging at the outlet 28—if need be after heat extraction—may be fed back again into the container 11 for the formation of foam. The gas (air) remaining behind during the centrifuging is directed in the intermediate space between the arms 15, 16 and the radial inner tubes 29, 30 to the axial outer tube 13 and may be extracted (in compressed form) at the outlet 27.

As already mentioned above, the base 23 of the container 11 consists of a porous material or a perforated plate. There is always a liquid layer 22 on the base 23. The gas (air) flows through the base 23 and forms bubbles when passing through the liquid layer 22. A fresh foam 21 is thus always obtained.

At initial volumetric ratios of $\epsilon = 0.9$ (in the case of the air/water mixture), the mass ratio of water to air is 85.9, i.e. the heat released during the compression of the air is absorbed by the water without an appreciable temperature increase occurring.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States:

1. A method of compressing a gas, comprising the steps of:

forming a foam from the gas and a liquid;

directing the foam to a sonic velocity through a nozzle, thereby compressing the gas; and separating the compressed gas and liquid from one another behind the nozzle.

2. The method as claimed in claim 1, wherein an essentially static foam is produced, and wherein the nozzle is moved at supersonic velocity through the foam.

3. The method as claimed in claim 2, wherein the movement of the nozzle is executed as a circular movement about an axis of rotation.

4. The method as claimed in claim 3, wherein the foam is collected behind the nozzle in a collecting container moving along with the nozzle, and wherein the centrifugal force arising in the collecting container during the rotation is used for the separation of gas and liquid.

5. The method as claimed in claim 1, wherein, to produce the foam, the gas is introduced into a volume of the liquid in a distributed manner.

6. The method as claimed in claim 5, wherein the gas is introduced from below through a porous base into a layer of the liquid above the base.

7. The method as claimed in claim 1 wherein, to stabilize the foam, at least one surface-active substance is admixed with the liquid before the formation of the foam.

8. The method as claimed in claim 1, wherein air is compressed, and wherein the liquid used is water.

9. The method as claimed in claim 8, wherein butylglycol, in particular with the formation of a 1 to 5% solution, is added as a surface-active substance to the water.

10. A compression apparatus, comprising:

first means for producing a foam;

a container for containing the foam produced, the container being connected to the first means;

at least one nozzle for passing the foam at supersonic velocity through the at least one nozzle; and second means for separating the foam into gas and liquid, the second means being arranged behind the nozzle.

11. The compression apparatus as claimed in claim 10, wherein the first means comprise a porous base, which closes off the container at the bottom and to which gas can be admitted over the surface area from the underside.

12. The compression apparatus as claimed in claim 10, wherein the at least one nozzle is arranged inside the container on an arm so as to be rotatable about a central axis of rotation and essentially tangentially to a circle of rotation, and wherein the arm is driven by a motor.

13. The compression apparatus as claimed in claim 12, wherein each second means comprise a collecting container, which is attached behind the nozzle and connected to the nozzle, each second means being arranged on the arm, and wherein third means are provided for each second means for the separate discharge of the gaseous and liquid components separating during the rotation in the collecting container.

14. The compression apparatus as claimed in claim 13, wherein the arm is of tubular design, wherein the third means comprise a first inner tube running inside the arm, and wherein the liquid is drawn off through the first inner tube and the gas is drawn off in the intermediate space between the first inner tube and the arm.

15. The compression apparatus as claimed in claim 14, wherein an outer tube and a second inner tube, through which the gas and respectively the liquid are directed out of the container after their separation, are arranged concentrically in the axis of rotation, and wherein the arm is connected to the outer tube and the first inner tube is connected to the second inner tube.

16. The compression apparatus as claimed in claim 12, wherein a plurality of nozzles, distributed over a circumference, are arranged so as to be rotatable inside the container on corresponding arms and are driven by the motor.

* * * * *